US006112371A

United States Patent [19]

Tremblay

[11] Patent Number: 6,112,371

[45] Date of Patent: Sep. 5, 2000

[54] ADJUSTABLE HINGE ASSEMBLY

[75] Inventor: Martin Tremblay, Laval-ouest, Canada

[73] Assignee: FERCO, Ferrures de Bâtiment Inc., Québec, Canada

[21] Appl. No.: 09/195,661

[22] Filed: Nov. 18, 1998

[51] Int. Cl.[7] ..... E05D 15/30

[52] U.S. Cl. ..... 16/362; 16/235; 16/DIG. 34; 411/238

[58] Field of Search ..... 16/DIG. 34, 362, 16/366, 370, 235; 411/522, 539, 540, 537, 238

[56] References Cited

U.S. PATENT DOCUMENTS

| | | | |
|---|---|---|---|
| 1,922,378 | 8/1933 | Linderman | 411/238 |
| 3,984,191 | 10/1976 | Doty | 411/522 |
| 4,478,455 | 10/1984 | Linde | 16/DIG. 34 |
| 4,729,703 | 3/1988 | Sato | 411/238 |
| 5,074,075 | 12/1991 | La See | 16/DIG. 34 |
| 5,152,102 | 10/1992 | La See | 16/DIG. 34 |
| 5,307,539 | 5/1994 | Bauman | 16/235 |
| 5,794,310 | 8/1998 | Dallmann | 16/235 |

*Primary Examiner*—Anthony Knight
*Assistant Examiner*—Mark Williams
*Attorney, Agent, or Firm*—Swabey Ogilvy Renault; Guy J. Houle

[57] ABSTRACT

An adjustable hinge assembly is comprised of a track to which is secured a slide member. A sash arm is secured at one end to the slide member and all along to a horizontal rail of a hinged window sash. A support arm is pivotally connected to the sash arm at one end thereof and pivotally connected to an adjustable connector at the other end. The improvement resides in the construction of the adjustable connector which is comprised of a stationary connecting post extending from a concentric circular disc and about which is positioned an adjustable nut. The nut is connected to the free end of the support arm and the top portion of the post is secured to the support arm by a sliding clip which is easily engaged and disengaged. Both the adjustable nut and the post are constructed from brass making them self-lubricating. The nut is also positioned in tight fit over the post whereby, when the nut is rotated to a desired position to adjust the position of the support arm, it will maintain the said position. The adjustable nut is rotated by a standard wrench tool.

12 Claims, 2 Drawing Sheets

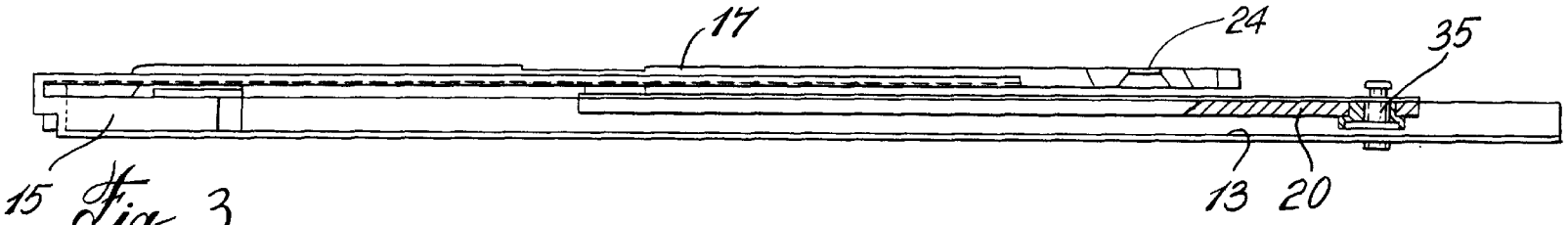
Fig. 3
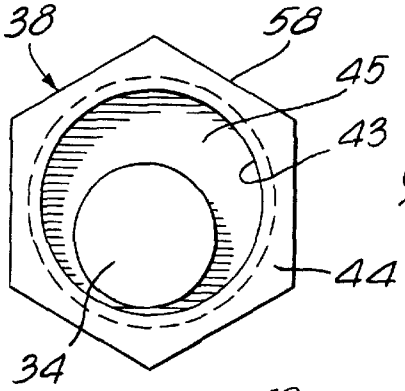
Fig. 5
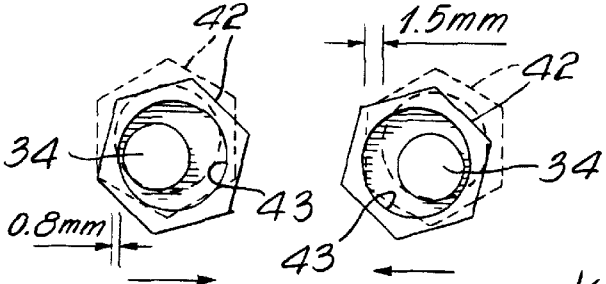
Fig. 6B
Fig. 6A
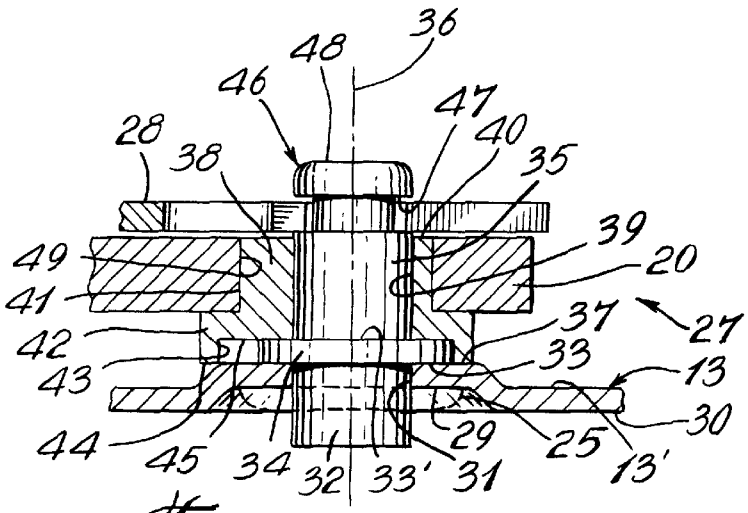
Fig. 4

ADJUSTABLE HINGE ASSEMBLY

TECHNICAL FIELD

The present invention relates to an adjustable hinge assembly particularly, but not exclusively, for casement windows where the window pane is hinged out of the window frame.

BACKGROUND ART

Similar adjustable hinge assemblies of the type as described herein are known and reference is made to Canadian Patent 2,075,170 issued on Feb. 4, 1997. It describes an adjustable casement hinge wherein the support arm is pivotally mounted to a stud which extends from an adjusting flange and wherein the stud is eccentrically disposed with respect to the rivet post which connects the stud to the track. The support arm is secured to the stud by a lock ring. A disadvantage of such attaching post is that the assembly can easily become loose after it has been adjusted thereby defeating its purpose. It is also difficult to connect and disconnect the support arm from the post due to the use of a lock ring. The lock ring can easily be lost as it is a separate element from the assembly. If lost, the installation cannot be completed. The friction between the lock ring and the connecting arm wears the protective treatment and thus creates rust.

SUMMARY OF INVENTION

It is a feature of the present invention to provide an adjustable hinge assembly having an adjustable connector which substantially overcomes the above-mentioned disadvantages of the prior art. Another feature of the present invention is to provide an adjustable hinge assembly which utilizes a stationary post and an adjustable nut in frictional fit therewith and rotatable thereon and wherein the nut is easily engageable by a standard type wrench tool and further wherein the adjustment nut and connecting post are fabricated from brass which is self-lubricating and rust resistant.

Another feature of the present invention is to provide an adjustable hinge assembly wherein the support arm is easily attached and detached to the adjustable connector by means of a sliding clip which is displaceably secured to the support arm and therefore cannot be lost during its installation or removal.

Another feature of the present invention is to provide an adjustable hinge assembly which is easy to install and adjust due to the simplistic construction of the adjustable connector.

Another feature is that the fit of the support arm over the post makes the arm more stable by reducing the vertical angular movement.

According to the above features, from a broad aspect, the present invention provides an adjustable hinge assembly which is comprised of a track adapted to be connected to a frame member. The track has a slide member which is slidingly retained thereon for displacement along a longitudinal straight axis thereof. An elongated first arm is pivotally connected at one end to the slide member. A support arm has a first end pivotally connected to the first arm at a predetermined location. The support arm has a second opposed end pivotally connected to an adjustable connector which is secured to the track at a predetermined location. The adjustable connector has a stationary connecting post of circular cross-section, which projects from a concentric circular disc secured to the track. An adjustable nut has an eccentric bore for receiving the post in close pressed frictional fit therein. The adjustable nut has a cylindrical top outer wall portion of circular cross-section, and a tool engaging portion defined therebelow. A circular cavity is provided in the bottom wall of the adjustable nut and has a flat base wall. The circular cavity is disposed concentric with the cylindrical top outer wall portion. The connecting post has a head portion which projects above a top wall of the adjustable nut. A connecting recess is provided in the head portion. The second opposed end of the support arm has a circular through bore for receiving the cylindrical top outer wall portion of the adjustable nut in close fit therein. Clamping mean is displaceably secured to the support arm and engageable with the connecting recess to pivotally secure the second opposed end of the support arm to the adjustable nut. The circular cavity is larger than the circular cross-section of the connecting post with the connecting post eccentrically positioned therein whereupon rotation of the nut by rotating the tool engaging portion thereof causes the support arm to be adjustably displaced when connected to the adjustable connector.

BRIEF DESCRIPTION OF DRAWINGS

A preferred embodiment of the present invention will now be described with reference to the accompanying drawings in which:

FIG. 3 is a sectional side view of the adjustable hinge assembly as shown in FIG. 1;

FIG. 4 is an enlarged cross-section view illustrating the construction of the adjustable connector and its relationship with the track and the support arm;

FIG. 5 is a bottom view showing the relationship of the circular cavity in the bottom wall of the adjustable nut with respect to the concentric circular disc which is secured to the base of the stationary post; and FIGS. 6A and 6B illustrate the displacement of the adjustable nut which is secured to the support arm when rotated about the stationary circular disc at the base of the stationary connecting post.

DESCRIPTION OF PREFERRED EMBODIMENTS

Figure 1:
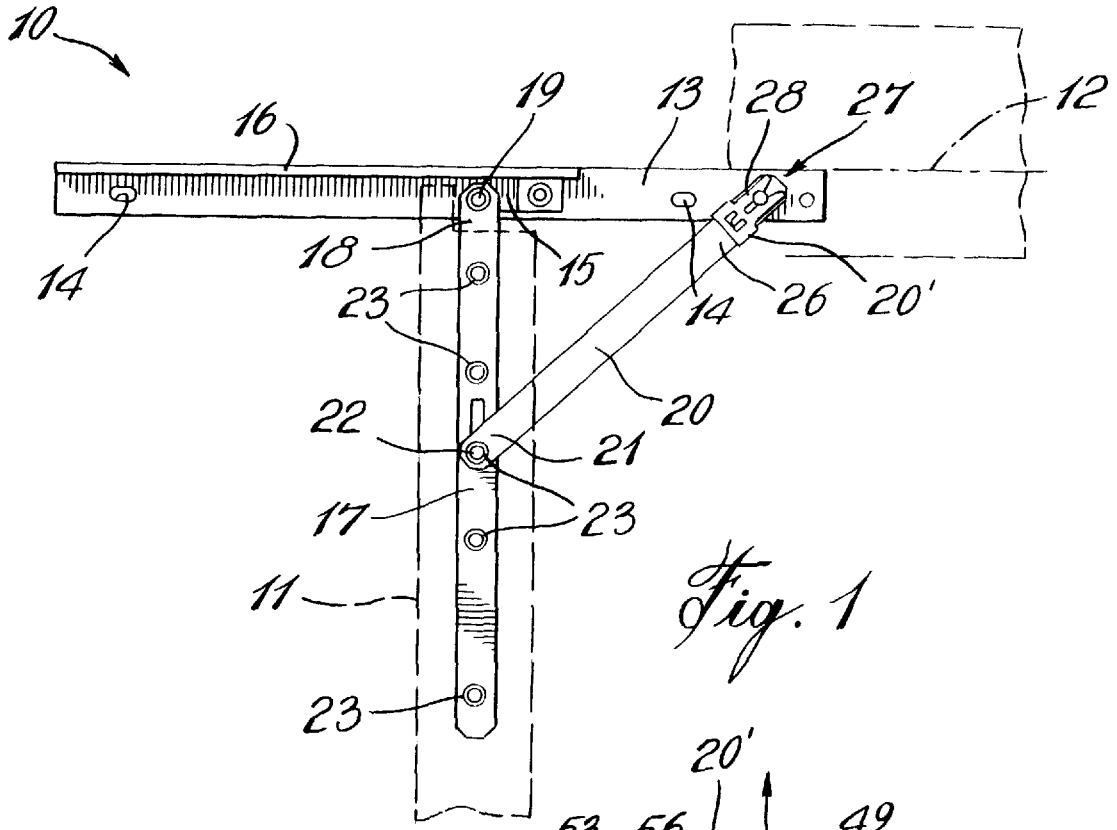
FIG. 1 is a plan view of an adjustable hinge assembly incorporating the adjustable connector of the present invention.

Referring now to the drawings and more particularly to FIG. 1, there is shown generally at 10 an adjustable hinge assembly particularly, but not exclusively, for use in connecting a casement window (not shown), but part of the horizontal rail 11 herein shown, to a window frame, a part 12 thereof being herein shown in phantom line. The hinge assembly is comprised of a track 13 which is provided with securing bores 14 for securing same to the frame 12. A slide member 15 is slidingly retained by a guide rail 16 for displacement over the track 13 along a longitudinal straight axis as defined by the guide rail.

An elongated first arm, herein a sash arm 17, is pivotally connected at one end 18 thereof by a pivot connection, herein rivet 19, to the slide member 15. A support arm 20 is pivotally connected at a first end 21 by a rivet 22 to a mounting bore 23. A plurality of mounting bores 23 are provided to connect the sash arm to the sash horizontal rail 11, herein partly shown in phantom line. The support arm has a second opposed end 26 which is pivotally connected to an adjustable connector 27. As hereinshown a connecting slide clip 28 is slidingly retained at the free end 26 to facilitate connection and disconnection to the adjustable connector 27, as will be described hereinbelow.

Figure 2:
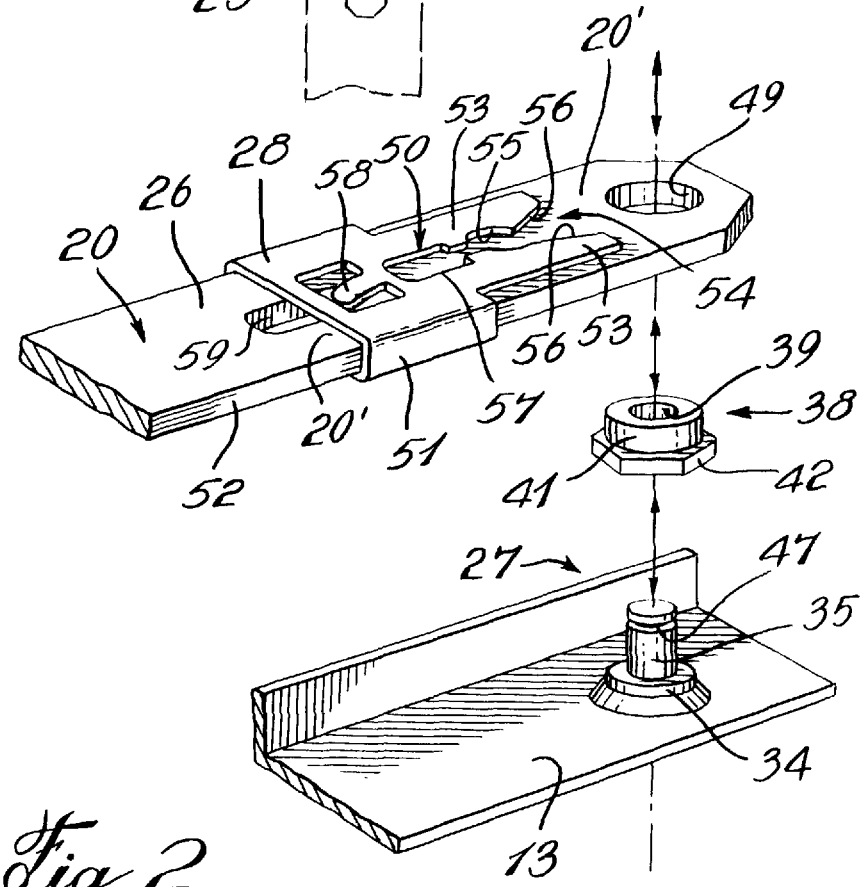
FIG. 2 is an exploded view showing the positioning of the adjustable nut onto the connecting post and into the circular bore at the free end of the support arm thereby illustrating their relationship.

With additional reference now to FIGS. 2 to 6B, there will be described the construction and operation of the adjustable connector which constitutes the improvement of the adjustable hinge assembly 10, hereinabove described. As shown in FIGS. 2 to 4, the adjustable connector 27 is secured to the track 13 at a predetermined location. As shown in FIG. 4, at this predetermined location, there is provided a depressed cavity 29 within the bottom face 30 of the track 13 and a circular bore 31 is formed in this depressed cavity to receive a rivet portion 32 extending from a bottom flat wall 33 of a circular disc 34. A connecting post 35 of circular cross-section projects from the center of the circular disc 34 and disposed concentrically therewith. The connecting post 35 and the rivet 32 are in axial alignment, i.e., both being aligned with the central longitudinal axis 36 of the post 35. The rivet portion 32 is collapsed within the depressed cavity 29, as shown by phantom lines 25, whereby to rigidly and immovably retain the circular disc 34 on the top wall 37 of the depressed cavity 29 and accordingly immovably retain the post 35.

An adjustable nut 38 is provided with a circular through bore 39 which is offset from the center in the top flat face 40 thereof. The adjustable nut also has a cylindrical top outer side wall portion 41 of circular cross section, and a tool engaging portion 42 which is defined therebelow.

As better seen in FIGS. 4 and 5, a circular cavity 43 is formed in the flat bottom wall 44 of the adjustable nut and has a flat base wall 45 for frictional displacement on the flat top wall 33' of the disc 34. The circular cavity 43 is disposed concentric with the cylindrical top outer wall portion 41.

As better seen in FIG. 4, the connecting post 35 has a head portion 46 which projects above the top wall 40 of the adjustable nut 38 and a connecting recess 47 is provided spaced below the top end 48 of the head portion. This connecting recess is formed as a circumferential channel about the connecting post.

As shown in FIG. 2, the second opposed end 26 of the support arm 20 is provided with a circular through bore 49 for receiving the cylindrical top outer wall portion 41 of the adjustable nut 38 in close friction rotational fit therein. The sliding clip 28 constitutes a clamping means as previously described and it is secured to the support arm 20 adjacent the circular through bore 49. The sliding clip 28 is provided with a clamping jaw portion 50 for engagement with the connecting recess 47 formed about the head portion of the connecting post 35. The sliding clip 28 is a spring steel metal clip and provided with a sleeve portion 51 which embraces the top wall 20' and the side edges 52 of the support arm 20. The clip is provided with a tooth 58 which extends inwardly into a clip retention slot 59 provided in the top wall 20 of the support arm 20 spaced a predetermined distance from the through bore 49 whereby to retain the clip on the support arm 20 and limit displacement thereof for engagement and disengagement and during adjustment of the connector 27. Accordingly, this clip cannot be lost during use.

The clamping jaw portion 50 is defined by a pair of spaced-apart flat metal projecting arms 53 which extend from the sleeve portion 51 and disposed on the top wall 20' of the support arm. A connecting slot 54 is formed between the projecting arms and it has a flared open end portion 56 and a clamping jaw section 55 rearwardly of the flared open end. The clamping jaw section 55 is defined by opposed arcuate cavities formed in a respective opposed edge of the slot. The slot also has a rear extension portion 57 rearwardly of the clamping jaw section 55. Accordingly, the projecting arms can flex outwardly when the connecting slot is slid into the connecting recess 47 of the stationary connecting post 35.

As shown in FIG. 4, the cylindrical top outer wall portion 41 of the adjustable nut 38 has a thickness substantially equal to the thickness of the support arm 20 so that the connecting recess 47 lies immediately above the top wall 20' of the support arm. The width of the connecting recess 47 is hereinshown as being wider than the thickness of the sleeve connector 28.

As can be seen from FIG. 5, the tool engaging portion 42 has a hexagonal-shaped contour 58 whereby the nut can be engaged by a standard wrench tool from various directions, the top wall 37 formed by the recessed cavity 29 is elevated from the top face 13' of the track 13. Therefore, as can be seen from FIG. 4, there is ample spacing between the support arm 20 and the top face 13' of the track 13 for inserting a standard wrench tool to turn the adjustable nut 38.

With reference now to FIGS. 5 to 6B, it can be seen that as the adjustable nut 38 is rotated about the concentric circular disc 34, the nut will be displaced relative to the circular disc as illustrated in FIGS. 6A and 6B. As the adjusting nut 38 is rotated it is displaced about the concentric stationary circular disc 34 in the manner as illustrated in FIGS. 6A and 6B. As the nut is rotated clockwise, as shown in FIG. 6A, it can effect a maximum displacement of 0.8 millimeters. When displaced counterclockwise, as illustrated in FIG. 6B, it can be displaced a maximum distance of 1.5 millimeters. Accordingly, a total displacement of 2.3 millimeters can be achieved by rotation of the adjusting nut. Because the top side wall portion 41 of the nut is in close fit with the circular bore 49 of the support arm 20, the support arm will be displaced relative to the stationary post. Because the sliding clip 28 is in sliding retention engagement with the support arm, it will remain engaged with the post as the slot 59 will accommodate the maximum displacement of the support arm by the adjustment nut 38. Accordingly, the connecting post 35 always remains stationary as well as the circular disc 34 thereby maintaining a solid connection with the track 13 to extend the life of the connector as compared with the prior art connector referred to herein.

It is also noted that because the post 35 and the adjusting nut 38 are constructed of brass, it provides self-lubrication as the nut 38 is rotated about the connecting post and the circular disc and is rust resistant. The circular disc is also formed of brass material so that all frictional moving parts are self-lubricating and rust resistant. This is particularly desirable due to the press fit connection between the post and the adjustment nut 38.

It is within the ambit of the present invention to cover any obvious modifications thereof provided such modifications fall within the scope of the appended claims.

What is claimed is:

1. An adjustable hinge assembly comprising a track adapted to be connected to a frame member, said track having a slide member slidingly retained thereon for displacement along a longitudinal straight axis thereof, an elongated first arm pivotally connected at one end to said slide member, a support arm having a first end pivotally connected to said first arm at a first predetermined location, said support arm having a second opposed end pivotally connected to an adjustable connector secured to said track at a second predetermined location, said adjustable connector having a stationary connecting post of circular cross-section projecting from a concentric circular disc secured to said track, an adjustable nut having an eccentric bore for receiving said post in close pressed frictional fit therein, said adjustable nut having a cylindrical top outer wall portion of circular cross-section and a tool engaging portion defined therebelow, a circular cavity in a bottom wall of said adjustable nut and having a flat base wall, said circular cavity being disposed concentric with said cylindrical top outer wall portion, said connecting post having a head portion projecting above a top wall of said adjustable nut, a connecting recess in said head portion, said second opposed end of said support arm having a circular through bore for receiving said cylindrical top outer wall portion of said adjustable nut in close fit therein, clamping means displaceably secured to said support arm and engageable with said connecting recess to pivotally secure said second opposed end of said support arm to said adjustable nut, said circular cavity being larger than said circular cross-section of said connecting post with said connecting post eccentrically positioned therein whereupon rotation of said nut by rotating said tool engaging portion thereof causes said support arm to be adjustably displaced while said support arm is maintained in connection to said adjustable connector.

2. An adjustable hinge assembly as claimed in claim 1 wherein said clamping means is a sliding clip secured to said support arm adjacent said circular through bore, said sliding clip having a clamping jaw portion for engagement with said connecting recess of said head portion of said connecting post.

3. An adjustable hinge assembly as claimed in claim 2 wherein said sliding clip has a metal sleeve portion embracing a top wall of said support arm, a tooth formed in said metal sleeve adjacent said top wall and depending into a clip retention slot formed in said top wall of said support arm to thereby provide restricted sliding fit retention for engagement and disengagement of said clamping jaw with said connecting recess and also permitting displacement of said support arm by said adjustable connector, said clamping jaw portion being defined by a pair of spaced-apart flat metal projecting arms extending from said sleeve and disposed on said top wall of said support arm, said clamping jaw portion defining a connecting slot between said projecting arms.

4. An adjustable hinge assembly as claimed in claim 2 wherein said connecting slot has a flared open free end and a clamping jaw section rearwardly of said flared open free end, said clamping jaw section being defined by opposed arcuate cavities formed in a respective opposed edge of said slot, said slot having a rear extension portion rearwardly of said clamping jaw section to provide flexing of said projecting arms.

5. An adjustable hinge assembly as claimed in claim 4 wherein said sliding clip is formed form spring steel whereby said projecting arms are flexible arms.

6. An adjustable hinge assembly as claimed in claim 1 wherein said stationary connecting post is immovably connected at a lower end thereof to said concentric circular disc, said disc being immovably connected to a top face of said track by a rivet extending from a bottom wall of said circular disc and extending in axial alignment with said connecting post, said rivet being collapsed in a depressed cavity formed in a bottom face of said tack.

7. An adjustable hinge assembly as claimed in claim 1 wherein said cylindrical top outer wall portion of said adjustable nut has a thickness substantially equal to the thickness of said support arm.

8. An adjustable hinge assembly as claimed in claim 1 wherein said first arm is a sash arm having one or more through bores between said first predetermined location where said support arm is pivotally connected thereto for connection to a sash horizontal rail.

9. An adjustable hinge assembly as claimed in claim 1 wherein said tool engaging portion of said adjustable nut is constituted by a hexagonal shape contour of said nut for engagement by a standard wrench tool.

10. An adjustable hinge assembly as claimed in claim 9 wherein rotation of said nut causes said circular cavity in said bottom wall of said adjustable nut to be displaced eccentrically about said circular disc to effect an adjustable displacement of up to 2.3 millimeters.

11. An adjustable hinge assembly as claimed in claim 1 wherein said connecting recess in said head portion is formed by an annular channel about said connecting post.

12. An adjustable hinge assembly as claimed in claim 1 wherein said connecting post and said adjustable nut are constructed of brass material whereby to achieve a self-lubricating connection therebetween.

* * * * *